US005810700A

United States Patent [19]

Orcutt

[11] Patent Number: 5,810,700

[45] Date of Patent: Sep. 22, 1998

[54] EXERCISE BALL WITH STRETCHABLE STRAPS

[76] Inventor: Terry L. Orcutt, 8601 E. Indian Bend Rd., Scottsdale, Ariz. 85250

[21] Appl. No.: 729,491

[22] Filed: Oct. 11, 1996

[51] Int. Cl.[6] ..... A63B 21/02

[52] U.S. Cl. ..... 482/123; 482/121

[58] Field of Search ..... 482/77, 123, 124, 482/126, 121; 473/423–430

[56] References Cited

U.S. PATENT DOCUMENTS

| | | | |
|---|---|---|---|
| 777,478 | 12/1904 | Minor . | |
| 1,782,254 | 11/1930 | Breidenbach . | |
| 3,351,343 | 11/1967 | Papp | 473/430 |
| 3,520,534 | 7/1970 | Bennett | 482/77 |
| 3,709,491 | 1/1973 | Minchin . | |
| 3,918,618 | 11/1975 | Castaneda | 294/157 |
| 4,071,239 | 1/1978 | Ferguson . | |
| 4,218,057 | 8/1980 | Wilson . | |
| 4,247,117 | 1/1981 | Reichert . | |
| 4,372,561 | 2/1983 | Morgan et al. . | |
| 4,592,549 | 6/1986 | Ryan . | |
| 4,685,671 | 8/1987 | Hagerman et al. . | |
| 4,720,095 | 1/1988 | Sowards . | |
| 4,722,523 | 2/1988 | Yang | 482/126 X |
| 4,733,862 | 3/1988 | Miller . | |
| 4,779,867 | 10/1988 | Hinds . | |
| 4,846,464 | 7/1989 | Jorno . | |
| 4,867,451 | 9/1989 | Mitchell . | |
| 4,943,055 | 7/1990 | Corley . | |
| 5,236,411 | 8/1993 | Backman | 602/20 |
| 5,242,348 | 9/1993 | Bates . | |
| 5,254,064 | 10/1993 | Rock | 482/123 X |
| 5,280,843 | 1/1994 | Vartija et al. . | |
| 5,398,940 | 3/1995 | Derst, III | 473/430 |
| 5,413,543 | 5/1995 | Drago | 482/123 |
| 5,415,609 | 5/1995 | Yang . | |
| 5,443,576 | 8/1995 | Hauter | 473/424 |
| 5,514,059 | 5/1996 | Romney . | |
| 5,522,757 | 6/1996 | Ostrowski . | |
| 5,551,934 | 9/1996 | Binette | 482/123 |
| 5,713,805 | 2/1998 | Scher et al. | 473/426 |

FOREIGN PATENT DOCUMENTS

| | | | |
|---|---|---|---|
| 441944 | 6/1912 | France . | |
| 2308752 | 9/1973 | Germany | 482/126 |

*Primary Examiner*—Richard J. Apley
*Assistant Examiner*—Denise Pothier
*Attorney, Agent, or Firm*—Snell & Wilmer

[57] ABSTRACT

An exercise apparatus includes a resilient ball, a flexible strap assembly, and a resistance member coupled to the resilient ball via the flexible strap assembly. The resilient ball is configured such that a user rests a portion of his or her body on the resilient ball while pulling the resistance member in an elongation direction. The strap assembly includes first and second straps adapted to surround and couple to the resilient ball. A loop formed from one of the straps receives the resistance member.

13 Claims, 5 Drawing Sheets

EXERCISE BALL WITH STRETCHABLE STRAPS

FIELD OF THE INVENTION

The present invention relates-generally to exercise equipment. More specifically, the present invention relates to exercise equipment that employs elastomeric resistance members.

BACKGROUND OF THE INVENTION

The prior art is replete with exercise, physical therapy, sports, and recreational equipment designed for physical manipulation by a user. For example, soft exercise balls (commonly known as "Swiss" balls) are primarily used for therapeutic exercises and occasionally employed during stretching, warm-up, and low-impact exercises. Typically, a user's body is supported by a Swiss ball during use, and the ball deforms to follow the natural contours of the user's body. Swiss balls may be utilized to develop a user's stability, flexibility, balance, and coordination.

Although useful for many purposes, Swiss balls are not particularly suited for traditional strength training programs, which typically employ resistance training to stimulate muscle growth or muscle strength. A Swiss ball may be employed during "squeezing" exercises of the arms or legs that do not require the user to rest upon the ball. Consequently, a Swiss ball cannot be easily incorporated into a strength training regimen without forfeiting the traditional benefits associated with Swiss ball therapy, namely, the development of flexibility, balance, and seldom-used stabilizer muscles.

A "home gym" device enables a user to perform a variety of exercises in the privacy of his or her home. However, such devices can be bulky, difficult to operate, or expensive to purchase, and users of such devices may be limited to only a small number of different exercises. On the other hand, simple and inexpensive home gym devices may not be configured to perform a large number of different exercises. In addition, conventional home gym equipment do not combine strength training with the additional benefits associated with Swiss ball exercises.

SUMMARY OF THE INVENTION

Accordingly, it is an advantage of the present invention that an improved exercise apparatus is provided.

Another advantage of the present invention is that the exercise apparatus incorporates an exercise ball that supports the weight of the user.

A further advantage of the present invention is that the exercise apparatus facilitates effective strength training in addition to the development of flexibility, balance, coordination, and stability.

Another advantage is that the exercise apparatus can be utilized to perform a variety of exercise movements.

Another advantage of the present invention is that the exercise apparatus is relatively inexpensive and simple to use.

A further advantage is that a conventional exercise ball can be quickly and easily modified into an exercise apparatus according to the present invention.

The above and other advantages of the present invention are carried out in one embodiment by an exercise apparatus having a resilient ball adapted to support a user performing exercises and a resistance member coupled to the ball. The resistance member is configured to resist elongation in response to an applied pulling force. The exercise apparatus is configured to allow a user to rest a portion of his or her body on the ball while pulling the resistance member in an elongation direction.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE EXEMPLARY EMBODIMENTS

Figure 1:
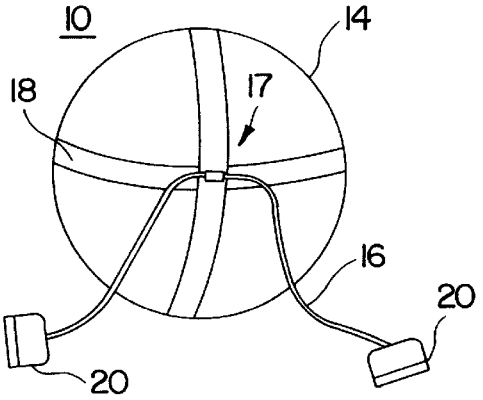
FIG. 1 shows an exercise apparatus according to a preferred exemplary embodiment of the present invention.
Figure 2:
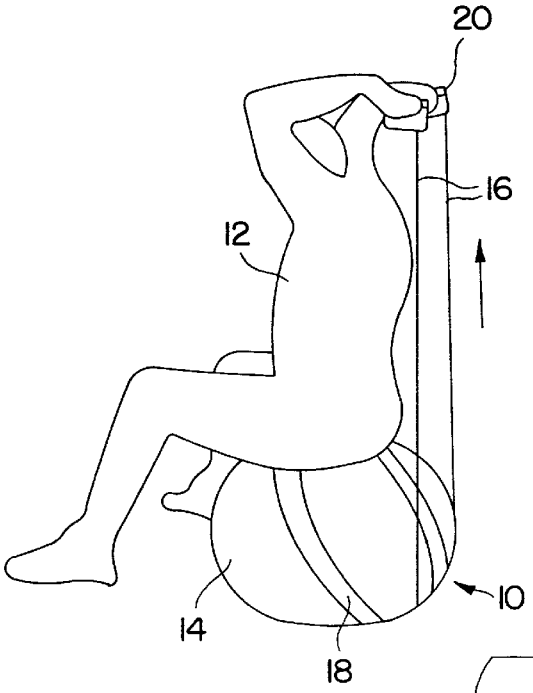
FIG. 2 illustrates an exemplary use of the exercise apparatus.

FIG. 1 shows an exercise apparatus 10 according to an exemplary embodiment according to various aspects of the present invention and FIG. 2 illustrates an exemplary use of apparatus 10. Although FIG. 2 shows a user 12 performing a specific exercise, nothing limits the use of apparatus 10 to any particular exercise. Indeed, apparatus 10 is preferably configured to enable user 12 to conveniently perform a number of different exercise movements to train a variety of muscle groups. The shape, size, and other physical characteristics of apparatus. 10 may vary, for example to suit the needs of the specific application, user, or production limitations.

Exercise apparatus 10 generally includes a ball 14, a resistance member 16, and a coupling assembly 17 for coupling resistance member 16 to ball 14. Apparatus 10 is configured to allow user 12 to rest a portion of his or her body on ball 14 while pulling resistance member 16 in an elongation direction (indicated by the arrow in FIG. 2).

Ball 14 is adapted to support user 12 while he or she performs exercises upon ball 14. Ball 14 may be formed from a soft, strong, and durable material such as nylon, polyurethane, rubber, or the like. In a preferred embodiment, ball 14 is hollow and may be inflated to a desirable gas or fluid pressure to lend a resilient property to ball 14. The specific size, shape, and composition of ball 14 may vary to suit the specific application and/or to meet the specific needs of user 12.

Ball 14 is preferably spherical in an undeformed state (although it may deform under the weight of user 12). FIG. 1 depicts ball 14 having an undeformed diameter of approximately two feet. The spherical shape enables user 12 to manipulate his or her body comfortably upon ball 14 during kinetic "rolling" exercises while facilitating the development of balancing and stabilizing muscles during static exercises that may involve resistance training.

Resistance member 16 is configured to provide resistance in response to a force applied by user 12. As shown in FIGS. 1–2, resistance member 16 may include a number of handles 20 to enable user 12 to effectively perform the exercises. Although not shown, resistance member 16 may alternatively include stirrups, collars, belts, or other furnishings for engaging various body parts during exercise. Such furnishings are suitably removable and interchangeable to facilitate different exercises.

In the preferred embodiment, resistance member 16 is formed from a length of rubber or polyurethane tubing. Alternatively, resistance member 16 may be formed from a spring element, a plurality of elastic bands, a sheet of elastic ribbon, or any suitable material for generating resistance. The resistance of resistance member 16 may be selected according to several factors, such as the thickness of a resistance material or a particular composition of an elastomeric material. In addition, exercise apparatus 10 may include a tension adjuster 22 (see FIGS. 5–6) for varying the length and effective tension of resistance member 16 (described below). Further, apparatus 10 is suitably compatible with more than one resistance member 16, either singly or in combination, to facilitate variations of resistances or exercises.

Figure 3:
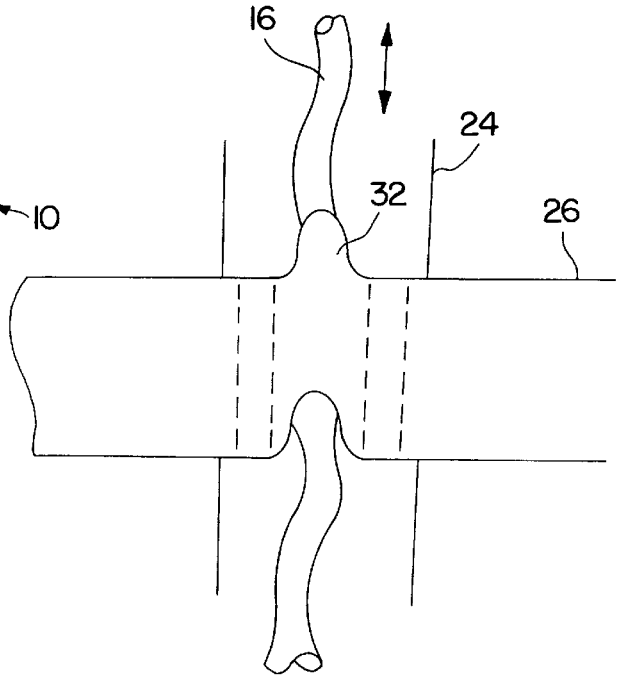
FIG. 3 is a detailed perspective view of a flexible strap assembly utilized by the exercise apparatus.

Coupling assembly 17 comprises any suitable mechanism for connecting resistance member 16 to ball 14. For example, coupling assembly 17 suitably comprises a flexible strap assembly 18, which surrounds at least a portion of the outer surface of ball 14 to provide a substantially stationary coupling point for resistance member 16 relative to ball 14. For example, as depicted in FIG. 3, flexible strap assembly 18 suitably includes a first flexible strap 24 and a second flexible strap 26 coupled to first flexible strap 24. Flexible straps 24, 26 are preferably formed from nylon or canvas webbing, and may be configured to be elastic or inelastic. In the embodiment shown in FIGS. 1–4, flexible straps 24, 26 are each approximately 1.5 inches wide and long enough to wrap around ball 14 in a substantially circumferential manner.

Flexible straps 24, 26 are preferably perpendicular relative to one another and are coupled together using a suitable mechanism, such as heavy duty stitching. The perpendicular relationship between flexible straps 24, 26 enables flexible strap assembly 18 to effectively couple to ball 14 to thereby form a stable foundation for resistance member 16 during use.

Figure 4:
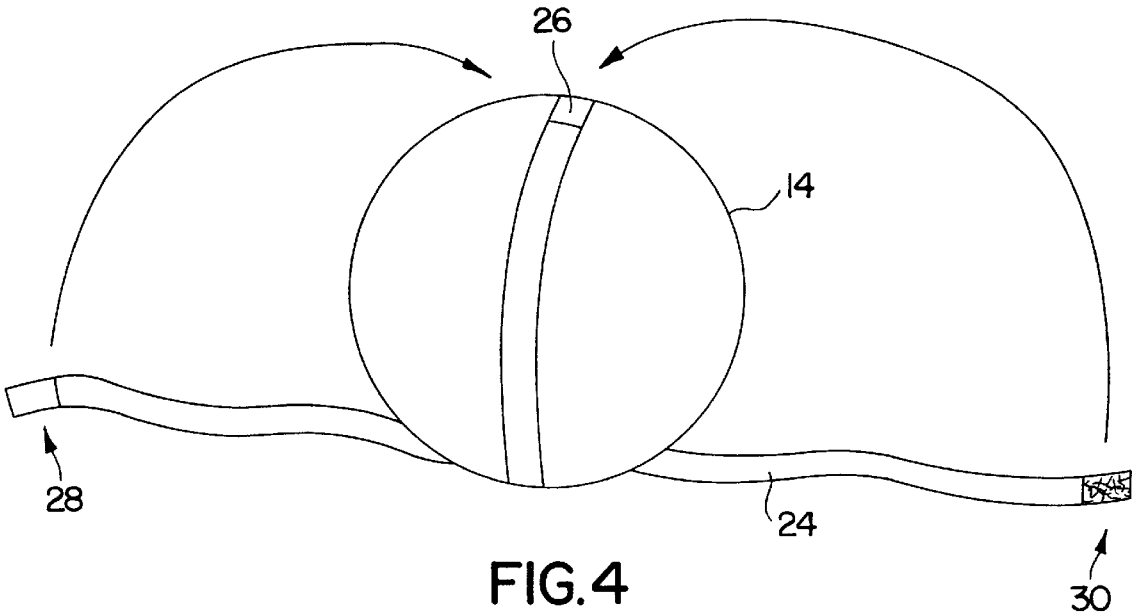
FIG. 4 illustrates the installation of the flexible strap assembly onto a resilient ball.
Figure 7:
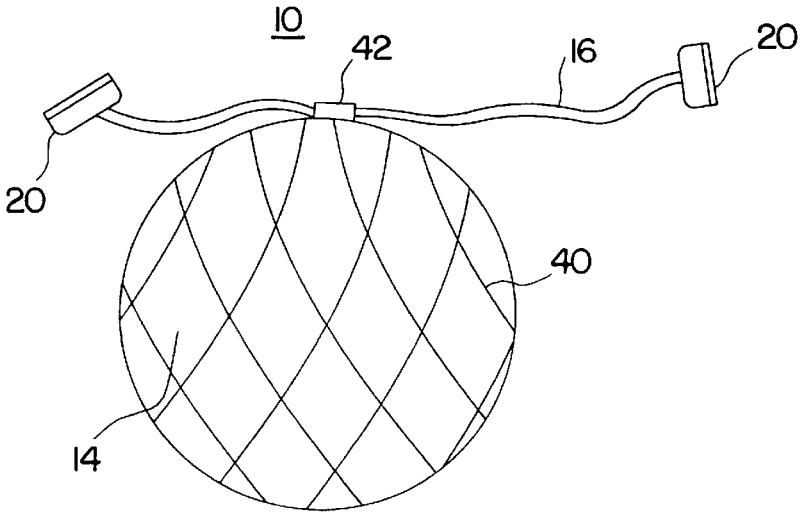
FIGS. 7–11 are perspective views of alternate embodiments of the present invention.

The respective ends of flexible straps 24, 26 may include cooperating elements that function to affix the ends together. With reference to FIG. 4, first flexible strap 24 includes a first end 28 and a second end 30. First end 28 includes a hook fastener element and second end 30 includes a corresponding loop fastener element. Second flexible strap 26 may include a similar configuration. When installing flexible strap assembly 18 onto ball 14, first and second straps 24, 26 are wrapped around ball 14 and the respective first and second ends are suitably affixed together via the cooperating fastener elements. Of course, the present invention may utilize any alternative fasteners such as snaps, buttons, or zippers to affix the strap ends together.

Flexible strap assembly 18 further includes a mechanism for attaching resistance member 16, such as a loop 32 configured to receive resistance member 16 (see FIG. 3). In practice, loop 32 may be suitably sized to receive handles 20 (or other furnishings) such that resistance member 16 and handles 20 can be easily installed and removed as a unit without disassembly. Furthermore, loop 32 is preferably sized such that resistance member 16 is capable of substantially free translational movement within loop 32 (as indicated by the arrow in FIG. 3). Translational movement of resistance member 16 is desirable to increase the versatility of exercise apparatus 10.

In the preferred embodiment, loop 32 is formed from a portion of one of flexible straps 24, 26. FIG. 3 depicts second flexible strap 26 attached to first flexible strap 24 such that loop 32 is formed over first flexible strap 24. The structure of loop 32 may be maintained by the stitching (or other suitable coupling technique) employed to attach flexible straps 24, 26 together. This arrangement is desirable from a manufacturing perspective and provides sufficient structural integrity to coupling assembly 17.

In an alternate embodiment (not shown), first flexible strap 24 includes an opening formed therein and loop 32 extends through the opening. As described above, the structure of loop 32 may be maintained by the stitching employed to attach flexible straps 24, 26 together.

Loop 32 is preferably configured such that it maintains resistance member 16 proximate the outer surface of ball 14. Such positioning reduces slippage of flexible strap assembly 18 when force is applied to resistance member 16 and inhibits excess movement of resistance member 16 relative to ball 14, particularly when resistance member 16 is not under tension.

In an alternate embodiment (not shown), loop 32 may be a distinct component coupled to one of flexible straps 24, 26. In addition, nothing requires that exercise apparatus 10 incorporate a coupling loop, i.e., apparatus 10 may include any suitable securing device coupled to one of flexible straps 24, 26, including eyelets, mountaineering clips, grommets, and other suitable devices.

Although not shown, exercise apparatus 10 may alternatively incorporate two or more separate resistance members coupled to ball 14 in any number of locations. The specific locations of such resistance members may be selected to suit the needs of individual users and/or to accommodate specific exercise movements. For example, coupling assembly 17 may be configured to include multiple connect points for one or more resistance members.

Figure 5:
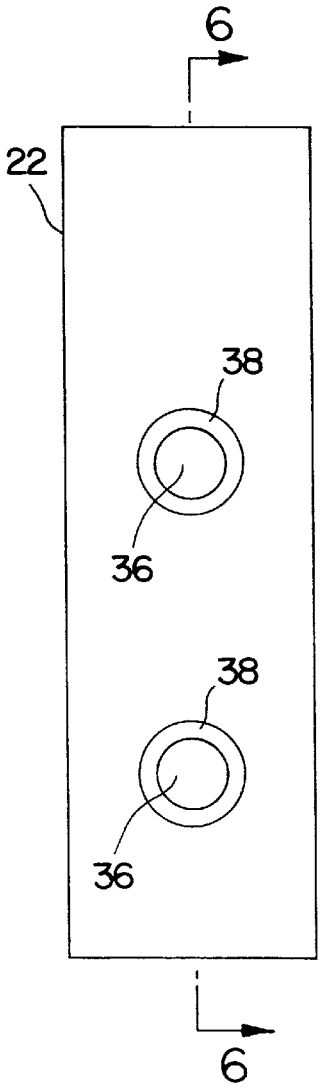
FIG. 5 is a front view of a tension adjuster employed by the exercise apparatus.
Figure 6:
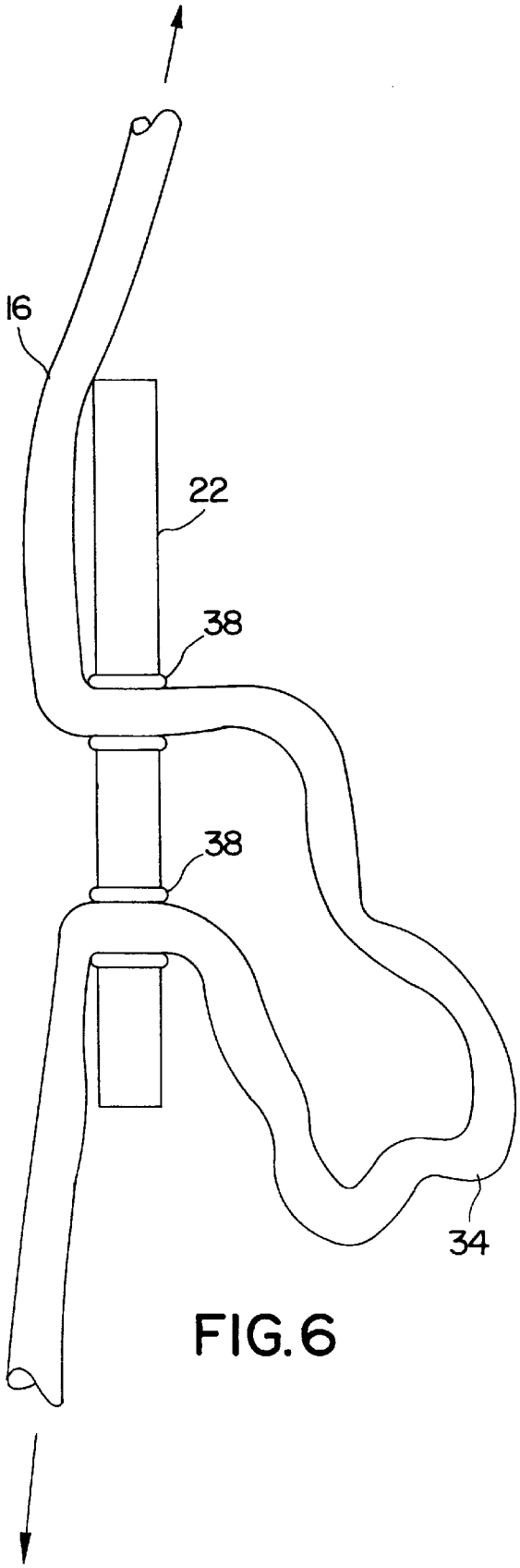
FIG. 6 is a sectional view of a resistance member installed in the tension adjuster as viewed along line 6—6 in FIG. 5.

Referring to FIGS. 5–6, tension adjuster 22 may be employed by exercise apparatus 10 to vary an elongation characteristic of resistance member 16. For example, the length of resistance member 16 can be shortened via tension adjuster 22 to increase the amount of pulling force required to elongate resistance member 16. As shown in FIG. 6, tension adjuster 22 resides on resistance member 16 such that a suitable portion 34 of resistance member 16 is effectively removed from the total length of resistance member 16.

Tension adjuster 22 includes two holes 36, each having a grommet 38 installed therein. Tension adjuster 22 may be formed from nylon webbing, polypropylene webbing, or similar materials, and grommets 38 may be formed from rubber, vinyl, steel, plastic, or the like. The diameter of grommets 38 is preferably less than the width of elastomeric member 16 (when unelongated). However, when resistance member 16 is stretched, its width reduces such that the position of tension adjuster 22 on resistance member 16 can be varied. In operation, the pulling direction imposed upon resistance member 16 (indicated by the arrows in FIG. 6) prevents slippage of resistance member 16 through grommets 38.

FIGS. 7–10 depict alternate embodiments of exercise apparatus 10. The embodiment illustrated in FIG. 7 utilizes a flexible net 40 to removably couple resistance member 16 to ball 14. Flexible net 40 is configured to substantially surround the outer surface of ball 14. Alternatively, a flexible outer shell 41, 25 illustrated in FIG. 11, may be employed rather than flexible net 40. A securing device 42 for resistance member 16 is coupled to flexible net 40. Securing device 42 may be configured in any manner described above in connection with the preferred embodiment.

Figure 8:
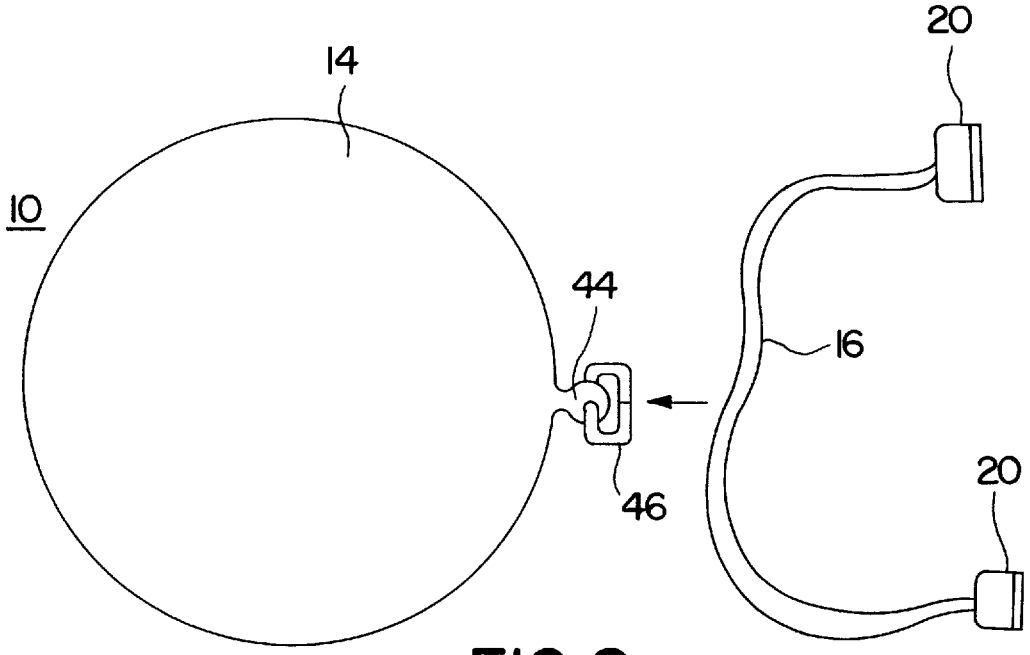
Figure 9:
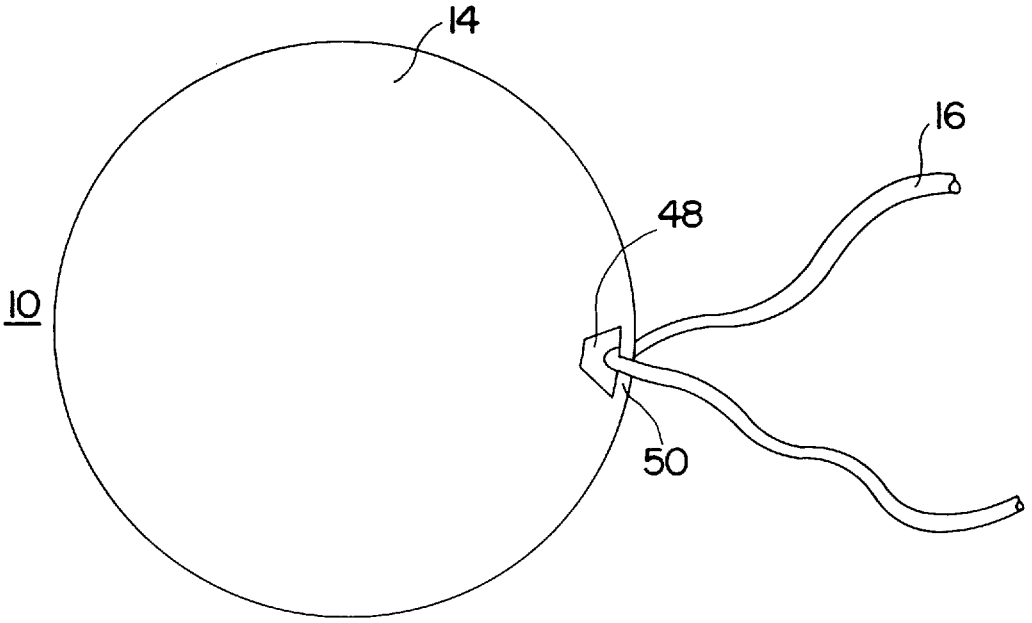

FIGS. 8–9 depict alternate embodiments that utilize integrated elements for removably attaching resistance member 16 to ball 14. As shown in FIG. 8, exercise apparatus 10 may employ an integral member 44, such as an eyelet or a loop, adapted to receive a securing device 46. Integral member 44 may be configured as a retractable or recessed plug or stem that facilitates substantially flush-mounting of resistance member 16 and/or securing device 46. A recessed securing arrangement allows ball 14 to be freely manipulated by the user, e.g., during rolling exercises. As described above, securing device 46 may be practically realized in any suitable manner.

FIG. 9 shows an alternate embodiment of exercise apparatus 10 that includes an aperture 48 through which resistance member 16 is passed. A support member 50 integral to ball 14 engages resistance member 16 when user 12 (see FIG. 2) applies a pulling force to resistance member 16.

Figure 10:
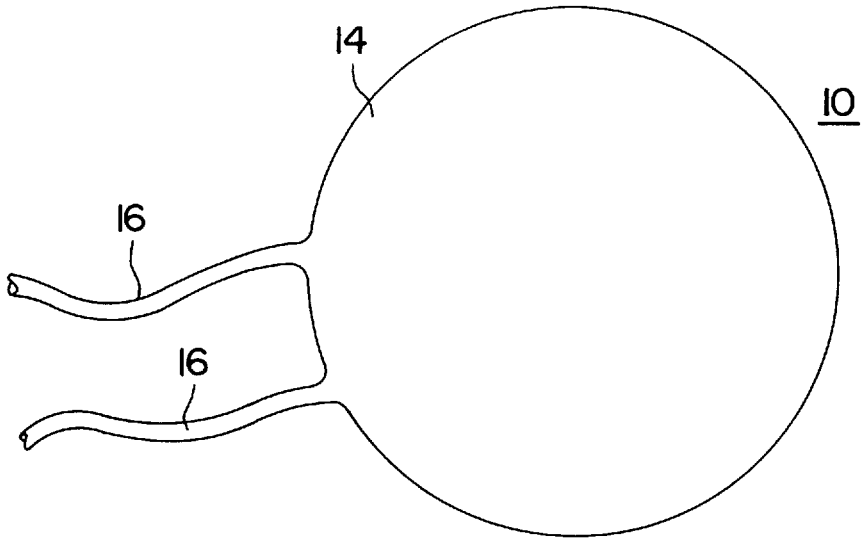
Figure 11:
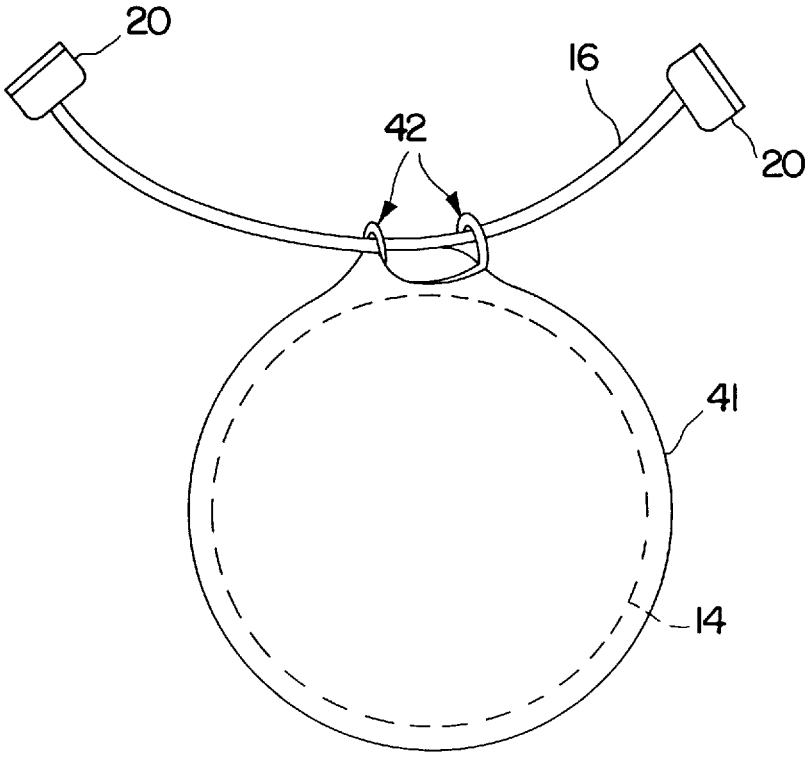

FIG. 10 illustrates a further embodiment of exercise apparatus 10. In this embodiment, at least one resistance member 16 is integrally formed within ball 14. Integral resistance members 16 may be desirable to reduce manufacturing costs and to simplify the use of exercise apparatus 14.

In summary, an exercise apparatus according to various aspects of the present invention incorporates an exercise ball configured to support the weight of a user. A conventional exercise ball can be quickly and easily modified into an exercise apparatus according to the present invention by coupling a resistance member to the ball. The exercise apparatus facilitates effective strength training in addition to the development of flexibility, balance, coordination, and stability. The exercise apparatus is relatively inexpensive and simple to use, and it can be employed in a versatile manner to perform a number of different exercise movements.

The present invention has been described with reference to preferred embodiments. However, those skilled in the art will recognize that changes and modifications may be made in the preferred embodiments without departing from the scope of the present invention. These and other changes and modifications that will be obvious to those skilled in the art are intended to be included within the scope of the present invention, as expressed in the following claims.

What is claimed is:

1. An exercise apparatus comprising:

a resilient ball configured to support a user performing exercises thereon; and a resistance member coupled to said ball, said resistance member being configured to resist a pulling force applied thereto; wherein said resistance member comprises at least one length of resilient cord configured to be stretched from each end by a user, and a removable coupling assembly configured to attach to said ball and secure to said resistance member, thereby coupling said resistance member to said ball, said removable coupling comprising a first flexible strap and a second flexible strap coupled to and substantially perpendicular to said first flexible strap, wherein the coupling of said first flexible strap to said second flexible strap forms a loop between the two straps and said loop is configured to receive said resistance member; and said exercise apparatus is configured to allow a user to rest a portion of his or her body on said ball while pulling said resistance member in an elongation direction.

2. An exercise apparatus according to claim 1, wherein said removable coupling assembly comprises:

a flexible shell configured to substantially conform to the outer surface of said ball; and a securing device connected to said flexible shell, said securing device being configured to receive said resistance member.

3. An exercise apparatus according to claim 1, wherein said removable coupling assembly comprises:

at least one flexible strap adapted to wrap around said ball; and a securing device connected to said at least one strap, said securing device being configured to receive said resistance member.

4. An exercise apparatus according to claim 1, wherein said resistance member is integrally formed within said ball.

5. An exercise apparatus according to claim 1, wherein:

said removable coupling assembly is substantially stationary relative to said ball; and said removable coupling assembly is configured to receive said resistance member such that said resistance member is capable of substantially free translational movement within said removable coupling.

6. An exercise apparatus comprising:

a resistance member configured to resiliently resist a pulling force applied thereto; and a removable coupling assembly for attachment to a resilient ball and configured to secure to said resistance member, thereby coupling a resilient ball to said resistance member; wherein said removable coupling assembly comprises a first flexible strap and a second flexible strap coupled to and substantially perpendicular to said first flexible strap, the coupling of said first flexible strap to said second flexible strap forming a loop between the two straps, said loop being configured to receive said resistance member;

said resistance member comprises at least one length of resilient cord configured to be stretched from each end by a user; and said exercise apparatus in operation allows a user to rest a portion of his or her body on a resilient ball configured to support a user performing exercises thereon while pulling said resistance member.

7. An exercise apparatus according to claim 6, wherein said removable coupling assembly is capable of surrounding at least a portion of the outer surface of a resilient ball.

8. An exercise apparatus according to claim 6, wherein said removable coupling assembly comprises:

a flexible net capable of substantially surrounding and conforming to the outer surface of a resilient ball; and a securing device connected to said flexible net, said securing device being configured to receive said resistance member.

9. An exercise apparatus according to claim 6, wherein said removable coupling assembly comprises:

at least one flexible strap capable of wrapping around a resilient ball; and a securing device connected to said at least one strap, said securing device being configured to receive said resistance member.

10. An exercise apparatus according to claim 9, wherein in operation each of said at least one strap is capable of wrapping around a resilient ball in a substantially circumferential manner.

11. An exercise apparatus according to claim 6, wherein said removable coupling assembly is configured to connect to said resistance member such that said resistance member is capable of substantially free translational movement within said removable coupling assembly.

12. An exercise apparatus according to claim 6, further comprising means for adjusting the length of said resistance member to vary a resistance characteristic of said resistance member.

13. An apparatus for removably coupling a resistance member to a deformable resilient ball adapted to support a user performing exercises thereon, said apparatus comprising:

a first flexible strap have first and second ends;

a second flexible strap coupled to said first flexible strap, said second flexible strap having first and second ends;

means for removably affixing said first end of said first flexible strap to said second end of said first flexible strap;

means for removably affixing said first end of said second flexible strap to said second end of said second flexible strap; and a securing device coupled to one of said first and second flexible straps, said securing device capable of receiving a resistance member; wherein said first and second straps in operation are capable of maintaining said securing device in a substantially stationary position relative to a deformable resilient ball; and the coupling of said first flexible strap to said second flexible strap forms a loop between the two straps; and said securing device comprises said loop.

* * * * *